US008864638B2

(12) United States Patent
Ross

(10) Patent No.: US 8,864,638 B2
(45) Date of Patent: Oct. 21, 2014

(54) PUSH-PULL HANDLES

(71) Applicant: Adam L. Ross, West Chester, OH (US)

(72) Inventor: Adam L. Ross, West Chester, OH (US)

(73) Assignee: Exemplar Design, LLC, Mason, OH (US)

( * ) Notice: Subject to any disclaimer, the term of this patent is extended or adjusted under 35 U.S.C. 154(b) by 158 days.

(21) Appl. No.: 13/621,307

(22) Filed: Sep. 17, 2012

(65) Prior Publication Data

US 2013/0072365 A1 Mar. 21, 2013

Related U.S. Application Data

(60) Provisional application No. 61/534,945, filed on Sep. 15, 2011.

(51) Int. Cl.

| | |
|---|---|
| ***A63B 21/00*** | (2006.01) |
| ***A63B 71/00*** | (2006.01) |
| ***A63B 21/16*** | (2006.01) |
| ***A63B 23/12*** | (2006.01) |

(52) U.S. Cl.

CPC ..... *A63B 21/1469* (2013.01); *A63B 21/1636* (2013.01); *A63B 23/1218* (2013.01); *A63B 23/1236* (2013.01)

USPC ..... 482/141

(58) Field of Classification Search

USPC ..... 482/23, 38–40, 44–50, 92–96, 139, 482/141; 292/256, 256.6, 256.65, 258

See application file for complete search history.

(56) References Cited

U.S. PATENT DOCUMENTS

| | | | | | |
|---|---|---|---|---|---|
| 864,188 | A | * | 8/1907 | Patterson | 482/96 |
| 1,430,573 | A | * | 10/1922 | Lindstrom et al. | 482/40 |
| 1,519,210 | A | * | 12/1924 | McGuckin | 269/221 |
| 1,540,375 | A | * | 6/1925 | Stodneck | 292/258 |
| 3,716,232 | A | * | 2/1973 | Johnson et al. | 482/40 |
| 3,850,490 | A | * | 11/1974 | Zehr | 439/92 |
| 4,415,150 | A | * | 11/1983 | Iezza | 482/42 |
| 4,685,760 | A | * | 8/1987 | Mize | 439/822 |

(Continued)

FOREIGN PATENT DOCUMENTS

EP 2052761 A1 4/2009

OTHER PUBLICATIONS

Johnson, Benjamen. "One-Handed Sliding Bar Clamp". Aug. 6, 2008. <http://toolmonger.com/2008/08/06/one-handed-sliding-bar-clamp/>.*

(Continued)

*Primary Examiner* — Stephen Crow
*Assistant Examiner* — Garrett Atkinson
(74) *Attorney, Agent, or Firm* — Baker & Hostetler LLP

(57) ABSTRACT

An exercise device for performing push ups and pull ups is disclosed. The device contains first and second tubes slidably engaged with a handle, which may be covered by a grip. A spring biases to the two tubes, drawing them inwardly together with respect to the handle. A first foot tube, including a first base, engages the second end of the first tube; a first button connector arranged to selectively lock the first foot tube with respect to the second end of the first tube. A second foot tube, including a second base, engages the second end of the second tube; and a second button connector selectively locks the second foot tube with respect to the second end of the second tube. The device may be engaged with a door frame to perform pull-ups.

6 Claims, 6 Drawing Sheets

(56) References Cited

U.S. PATENT DOCUMENTS

| | | | | | |
|---|---|---|---|---|---|
| 4,844,448 | A | * | 7/1989 | Niznik | 482/40 |
| 5,261,434 | A | * | 11/1993 | Fodero | 135/16 |
| 5,462,508 | A | * | 10/1995 | Schiavone | 482/122 |
| 5,507,712 | A | * | 4/1996 | Chang | 482/126 |
| 5,582,565 | A | * | 12/1996 | Soria | 482/141 |
| 5,690,596 | A | * | 11/1997 | Parker | 482/126 |
| 5,776,033 | A | * | 7/1998 | Brown | 482/40 |
| 5,853,168 | A | * | 12/1998 | Drake | 269/6 |
| 5,961,430 | A | * | 10/1999 | Zuckerman et al. | 482/142 |
| 6,129,650 | A | * | 10/2000 | Wedge, Jr. | 482/139 |
| 6,129,651 | A | * | 10/2000 | Denaro | 482/141 |
| 6,171,221 | B1 | * | 1/2001 | Hayduk | 482/139 |
| 6,367,787 | B1 | * | 4/2002 | Poole et al. | 269/6 |
| 7,008,354 | B2 | * | 3/2006 | Wen | 482/127 |
| D518,534 | S | * | 4/2006 | Giordano | D21/662 |
| D523,493 | S | | 6/2006 | Horton | |
| 7,604,582 | B2 | | 10/2009 | Abdallah | |
| 7,841,972 | B1 | * | 11/2010 | Huang et al. | 482/108 |
| 2002/0098959 | A1 | * | 7/2002 | Florek | 482/141 |
| 2006/0040809 | A1 | * | 2/2006 | Godbold | 482/141 |
| 2011/0190098 | A1 | * | 8/2011 | Griswold et al. | 482/40 |
| 2012/0302410 | A1 | * | 11/2012 | Kitchens et al. | 482/96 |
| 2013/0012360 | A1 | * | 1/2013 | Stone | 482/23 |
| 2013/0165298 | A1 | * | 6/2013 | Demsey | 482/40 |

OTHER PUBLICATIONS

GoFit Push-Up Bars advertised by GoFit—http://www.amazon.com/GoFit-GF-PUB-Push-Up-Bars/dp/B0007W2FLS/ref=sr_1_3?ie= . . . [Date retrieved—Sep. 17, 2013].

Harbinger 373500 Padded Handle Push-Up Bars by Harbinger—http://www.amazon.com/Harbinger-373500-Padded-Handle-Push-Up/dp/B000KFV9GO/r . . . [Date retrieved—Sep. 17, 2013].

Perfect 2 Pushup advertised by Perfect Fitness—http://www.amazon.com/Perfect-Fitness-31001-V2-Pushup/dp/BOO8DNAJ5M/ref=sr_1_2 . . . [Date retrieved—Sep. 17, 2013].

Reebok Adjustable Push-Up Handles advertised by Reebok—http://www.amazon.com/Reebok-RPUB08-Adjustable-Push-Up-Handles/dp/B000VDRW . . . [Date retrieved—Sep. 17, 2013].

* cited by examiner

PUSH-PULL HANDLES

CROSS-REFERENCE TO RELATED APPLICATIONS

This application claims the benefit of U.S. Provisional Application No. 61/534,945, filed Sep. 15, 2011, which is hereby incorporated by reference.

BACKGROUND

The present disclosure relates to exercise equipment, and more particularly, to exercise devices for bodyweight exercises. Some examples of exercise equipment and devices include multi-purpose, multi-functional exercise devices which allow a user to perform both push-ups and pull-ups.

SUMMARY

Exercise devices relating to push-ups and pull-ups are disclosed. Some example embodiments may include methods, apparatus, and/or systems associated with a user performing bodyweight exercises, specifically, pull-ups and push-ups. The exercise device disclosed may be used as a pair.

An exercise device according to the disclosure may have a generally L-shaped first tube ("first L-tube") including a handle end and a support end, and a generally L-shaped second tube ("second L-tube") including a handle end and a support end. A generally tubular handle may engage the handle end of the first L-tube and the handle end of the second L-tube. A spring within the handle may be biased to and between the handle end of the first L-tube and the handle end of the second L-tube. The spring may exert an inward force between the two tubes with respect to the handle.

A first foot tube may be slidably engaged with the support end of the first L-tube, and a selectable, spring-loaded button connector carried on the first L-tube may lock into a corresponding hole on the first foot tube. A second foot tube may be slidably engaged with the support end of the second tube, and a selectable, spring-loaded button connector may lock into a corresponding hole on the second foot tube.

The first foot tube and the second foot tube each may include a perpendicularly oriented base affixed to one end of the respective foot tube. A foot may at least partially cover each foot tube and its respective base. A foot pad or pads on the underside and inside of the base of the first foot tube and the second foot tube may help stabilize the exercise device to a surface.

The button selector locking mechanism to lock each set of L-tubes to each foot tube resists a bi-directional force applied to the handle whether the force of the handle is pushing towards, or pulling away from, the foot tube and bases. Thus, even with pressure, the handle remains locked at a same height from the bases until the button is released or unlocked.

The handle is disposed at a first height from the bases when a hole on the foot tubes engages the first button connecter on each L-tube. The handle is disposed at a second height when the hole on the foot tubes engages a second button connector set on the L-tubes.

The first L-tube and second L-tube may be slidably engaged with the handle. Alternately, one of the tubes may be slidably engaged with the handle, while the other tube is rigidly engaged with the handle. A hand grip may at least partially cover the handle.

The handle may be adapted to generally take on the shape of the L-tubes. An exemplary handle is rod-shaped, but other embodiments may have other configurations. For example, the L-tubes may be curved, or may contain multiple angles, to provide multiple grip and angle choices, e.g., grip choices perpendicular to each other.

The exercise device of this disclosure may be used as a push-up handle. As a push up handle, the device may be placed with the bases on a surface, and the handle facing upwards. The device provides a stable base and handle for the user to grip in performing push-ups.

The exercise device of this disclosure may be associated with a method to convert the device from a push-up handle to a pull-up handle. To convert the exercise device for use as a pull-up handle, a user widens a separation between the first foot and the second foot of the device by overcoming the spring force biased between the first L-shaped tube and the second L-shaped tube. Once the separation is sufficiently wide to clear the door frame and any moulding, the user flips the device and places the first tube foot and the second tube foot on either side of the wall above the door frame, with the bases against the wall. The user releases the resistance against the spring force and allows the device to engage the wall, with a clamping force.

When the exercise device is secured over the door frame, the widened separation between the first and second foot tubes may increase the compression force between the first foot and the second foot tubes. Thus, when performing a pull-up, the downward force on the exercise device may be supported by the compression, or clamping, force of the exercise device to the wall. Additional support to the door frame is provided by the molding.

When a force compresses the handle towards the bases, as when performing a push up, the bases may remain a stable distance with respect to each other. However, when the distance between the first foot tube and the second foot tube is widened beyond its natural position, as when the device is clamped on a door frame, the spring force may cause the first foot base and the second foot base to draw towards each other. This force is exerted against the wall of the door frame, and helps to stabilize the device against the doorframe When the handle is pulled in a direction perpendicular to, and away from the bases, the handle will exert that force on each leg. In the pull-up position, when the handle is pulled down, the foot tubes are pulled in a downward direction, forcing the foot tubes at the base to squeeze against the doorframe. More weight downwards will force the bases to draw inward, and help to stabilize the device against the doorframe.

BRIEF DESCRIPTION OF THE DRAWINGS

The foregoing and other features of the present disclosure will become more fully apparent from the following description of certain exemplary embodiments, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

In the drawings.

DETAILED DESCRIPTION

Figure 1:
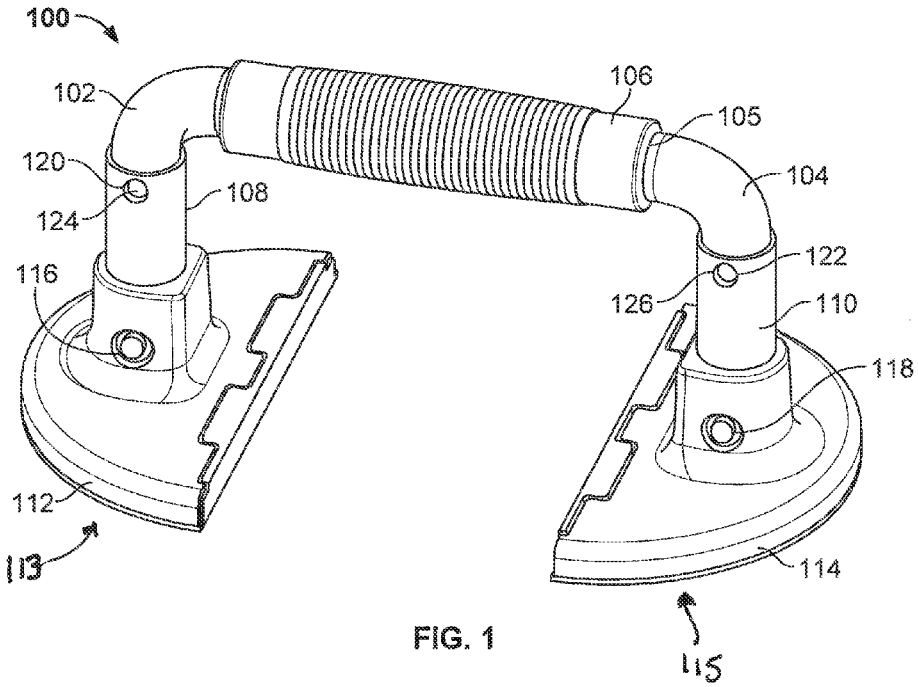
FIG. 1 is a perspective view of an exemplary exercise device according to the disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Methods, systems, devices, and/or apparatus related to exercise devices are described. Some example embodiments according to the present disclosure may pertain to push-up devices, or pull-up devices, to assist a user in performing push-ups and pull-ups.

FIG. 1 is a perspective view of a first exemplary embodiment of the exercise device 100, arranged in the push-up position. Exercise device 100 has a first L-shaped tube 102 ("first L-tube") and a second L-shaped tube 104 ("second L-tube"), where, in a first embodiment, L-tube 102 may be slidably fitted into L-tube 104, shown in FIG. 7, and rigidly engaged with handle 105, which may be covered by grip 106. In an alternate embodiment, shown in FIG. 7, L-shaped tubes 902 and 904 may be of the same diameter and both slidably engaged to, or fitted within, handle 905.

L-tubes 102 and 104 are respectively inserted in first foot tube 108 and second foot tube 110, and selectively locked into place with a coupling mechanism. In a first embodiment, foot tube 108 may contain a hole 120 adapted to selectively lock onto spring loaded button 124 or 125 on L-tube 102, and foot tube 110 may contain hole 122, adapted to lock onto spring loaded button 126 or 127 on L-tube 104. A user may adjust the height of the exercise device to a first or a second height by matching hole 120 and 122 with the selected spring loaded first button pair, 124 and 126, or second button pair 125 and 127 (shown in FIG. 3). It will be appreciated by those of ordinary skill that alternative coupling mechanisms may be used in place of the spring-loaded button couplings. For example, and without limitation, pins or threaded couplings may be used.

First foot tube 108 and second foot tube 110 may be inserted into, or otherwise connected to foot 113 and foot 115, respectively, each foot having a base 112, and base 114, respectively. Rivets 116, 118, or other attachments such as screws or pins, may secure the foot tubes 108, 110 to foot 113 and foot 115, respectively.

Figure 2:
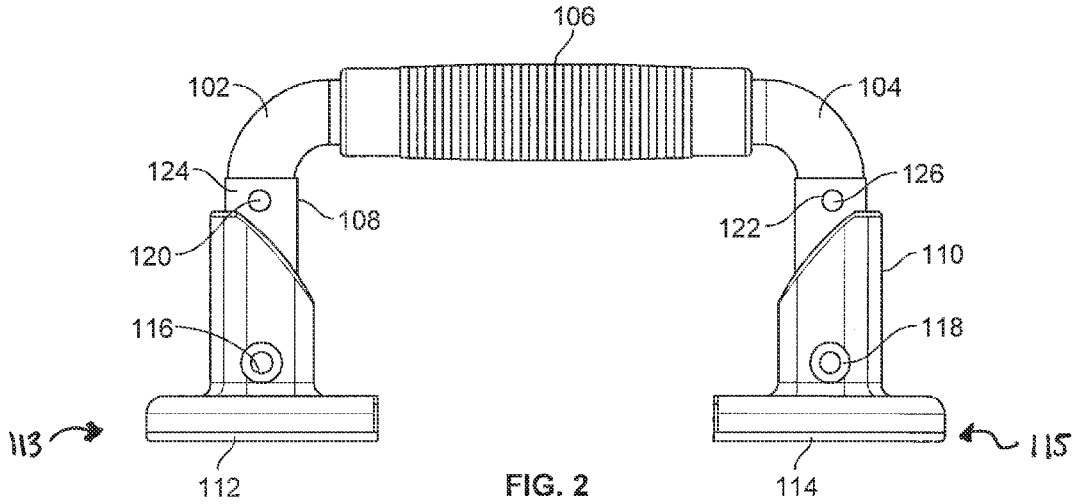
FIG. 2 is a front view of an exemplary exercise device according to the disclosure.
Figure 3:
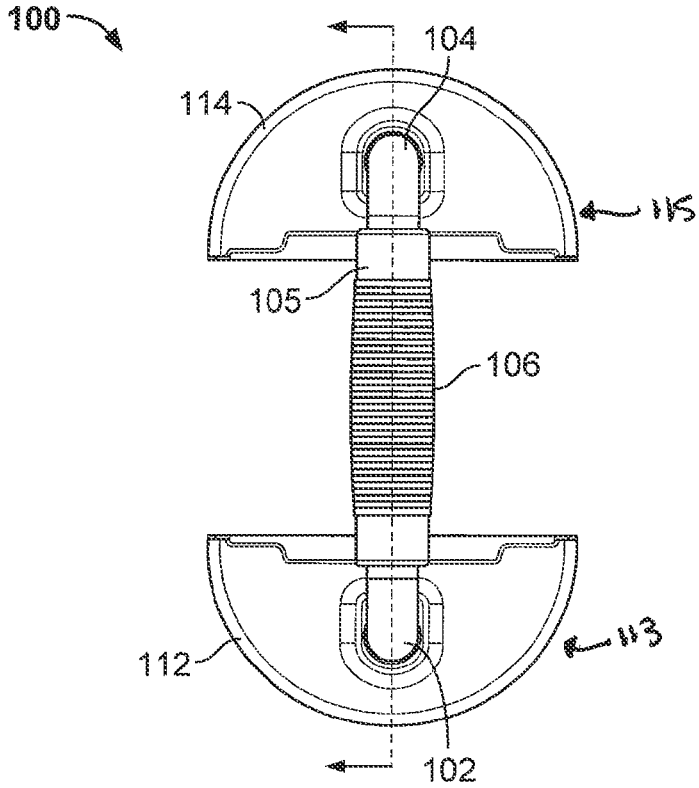
FIG. 3 is a top view of an exemplary exercise device according to the disclosure.
Figure 4:
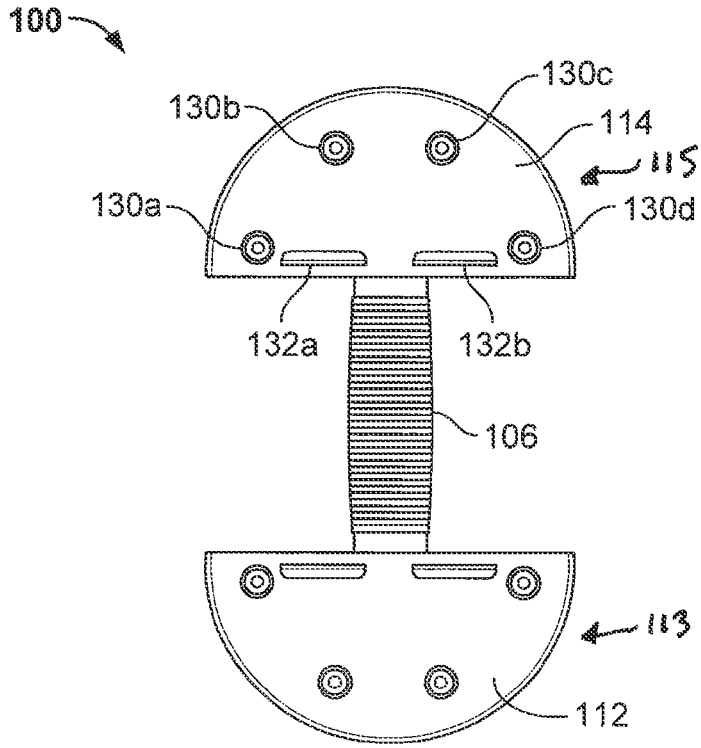
FIG. 4 is a bottom view of an exemplary exercise device according to the disclosure.

FIGS. 2-4 show an exemplary exercise device 100 from various perspectives. FIG. 2 shows an exemplary exercise device 100 from a front view. FIG. 3 shows an exemplary exercise device 100 from a top view; (or bottom view, depending on the orientation of the device 100). FIG. 4 shows an exemplary exercise device 100 from a bottom, or underside view. The bottom of bases 112 and 114 may include feet pads 130*a-d* and 132*a-b*, where pads 130, 132 may be of various shapes and arrangements covering bases 112, 114.

Figure 5:
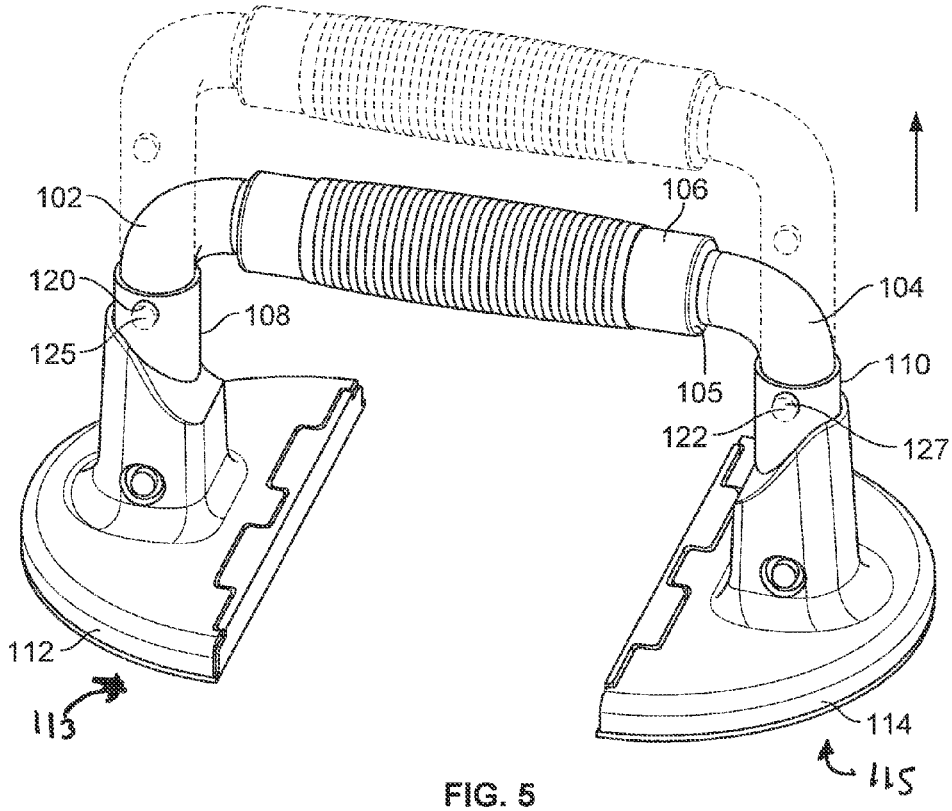
FIG. 5 is a perspective view of an exemplary exercise device, including a second position of the handle, according to the disclosure.

FIG. 5 is a perspective view of an exemplary exercise device 100, including a first and second height position of the handle 105. Handle 105 may be adjusted to a second height, where hole 120, 122 may lock and snap into second set of buttons 125, 127. This increased height of handle may provide an alternate push up angle, or allow the handle to be easily assessable when secured above a door frame 810.

Figure 6:
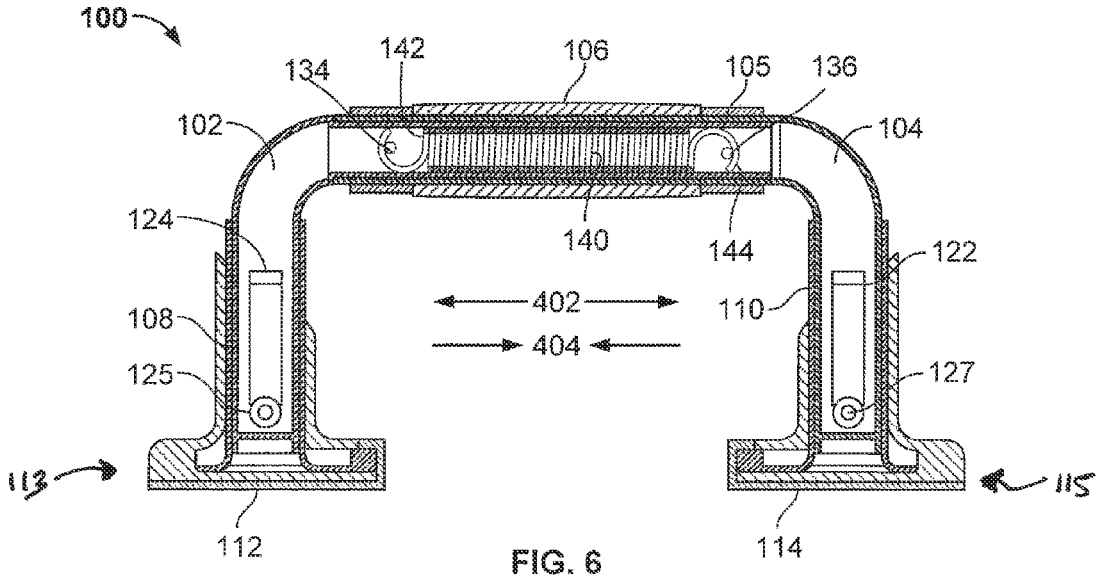
FIG. 6 is a cut-out view of an exemplary exercise device according to the disclosure.

FIG. 6 is a cut-out view of an exemplary exercise device 100. Both of sets of height stop buttons 124, 125 and 126, 127 are shown, although only one button set 124 and 126 is engaged. Spring 140 is shown within handle 105, where one end of spring 140 ends in a first hook 142 which is attached to a pin 136 on L-tube 104, and a second end of spring 140 ends in a second hook 144 attached to a pin 134 on tube 102. The handle end of tube 102 is telescoped into the handle end of tube 104, and handle 105 is rigidly engaged with tube 104. The support ends of tubes 102 and 104 are drawn together with the spring force.

Figure 7:
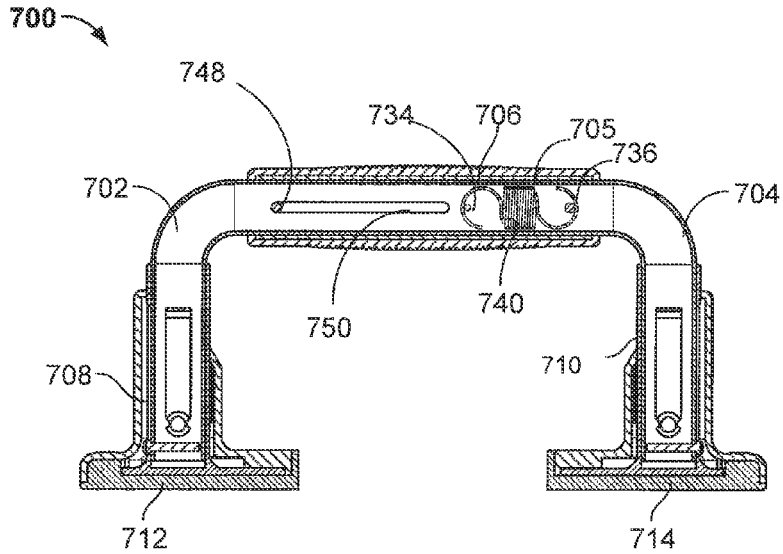
FIG. 7 is a cut-out view of an alternate exemplary embodiment of the exercise device according to the disclosure.

FIG. 7 shows an alternate embodiment of exercise device 700, in a cut-out view. The two L-shaped tubes 702 and 704 may be of the same diameter. One or both of tube 702 and tube 704 may be slidably engaged with tubular handle 705, and tubes 702, 704 may be fitted or telescoped within handle 705. A grip 706 may cover handle 705, which may be made from rubber, plastic, textured metal or another non-slip material. Spring 740 of device 700 is attached to tube 702 by pin 734, and to tube 704 by pin 736 so the spring force keep tube 702 and tube 704 from separating past the length of handle 706. In a first position, tube 702 and tube 704 may abut against each other, and in a second position tube 702 and tube 704 may be separated by a gap no larger than the length of handle 705. Slot 750 and pin 748 provide a track to prevent rotation of tube 702, tube 704, and handle 705. Handle 705 maintains a straight path for tube 702 and tube 704 to move along.

When the grip 706 is pulled in a direction perpendicular to, and away from the bases 712 and 714, the grip 706 force will be exerted on each foot tube 708, 710. In the pull-up position, when the grip 706 is being pulled down, the foot tubes 708, 710 at the base are pulled in the same downward direction, forcing bases 712, 714 to squeeze against a doorframe. More weight downwards will force the base of the legs 712, 714 to draw inward, and help to stabilize the device 700 against the doorframe.

Figure 8:
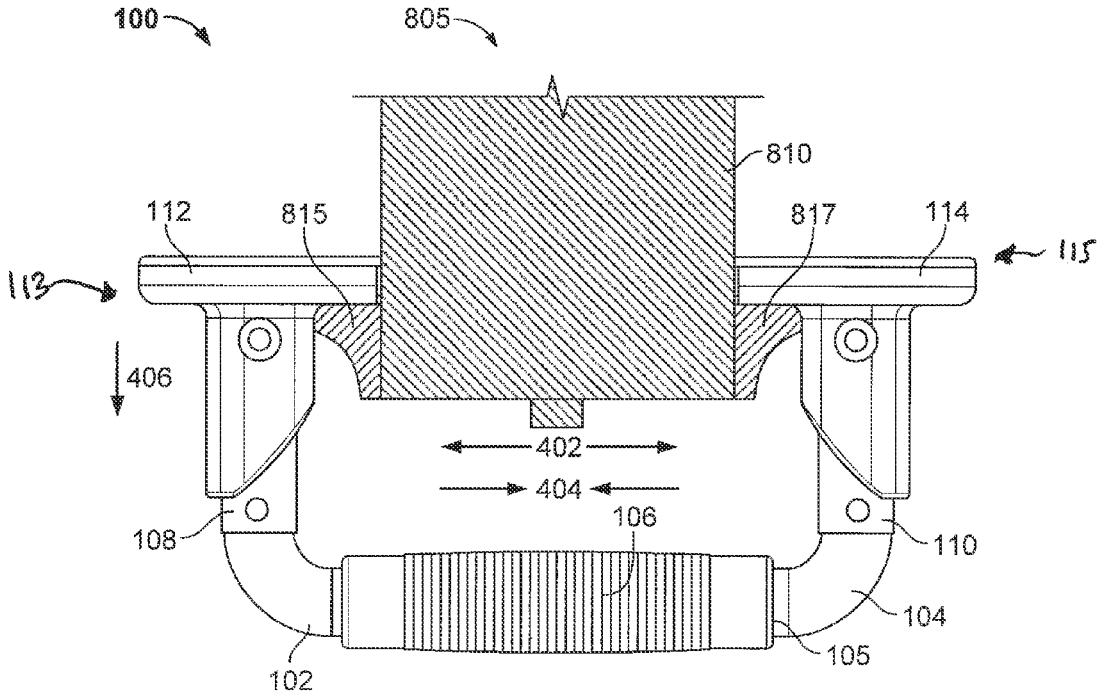
FIG. 8 shows an exemplary exercise device attached to the wall according to the disclosure, arranged for performing a pull-up.

FIG. 8 shows an exemplary exercise device 100 in place over door frame 810. Device 100 may straddle wall 800, base 112 and base 114 on either side of wall 800. Molding 815 and 817 may provide a ledge to support exercise device 100. Device 100 may be used as a pull-up device, and the weight of the user is distributed between the moulding 815 and 817, and a compression force into the wall 800. The compression force may stabilize device 100 to the wall 800 above the moulding 815, 817.

FIG. 6 and FIG. 7 shows the exercise device 100 in the push up position, with bases 112 and 114 on a surface, and handle

105 facing up. To convert the exercise device 100 from the push-up position of FIG. 6 and FIG. 7 to the pull-up position of FIG. 8, a user widens a separation 402 between the first foot tube 108 and the second foot tube 110 by overcoming the spring force 404 biased between the first L-shaped tube 102 and the second L-shaped tube 104. The user flips device 100 so handle 105 points downward, and so device 100 may straddle a door frame 805. Once the separation is sufficiently wide to clear the door frame 805 and any moulding 815, 817, the user places the first tube foot 108 and the second tube foot 110 on either side of the wall 810 above the door frame 805, resting bases 112 and 114 against the wall. The user releases the resistance against spring force 404 and allows device 100 to forcefully clamp wall 810.

When the exercise device 100 is secured over door frame 805 as in FIG. 8, the widened separation between the first and second foot tubes 108, 110 may increase the compression force between the first foot tube 108 and the second foot tube 110. Thus, when performing a pull-up, the downward force 406 on the exercise device 100 is supported by the compression, or clamping, force 404 of the exercise device 100 to the wall 810. Exercise device 100 is further secured over door frame 805 by the ledge formed by moulding 815, 817 to the bases 112, 114. The compression force 404 between the first and second foot tubes 108, 110 prevent the bases 112, 114 from slipping off moulding 815, 817.

Figure 9:
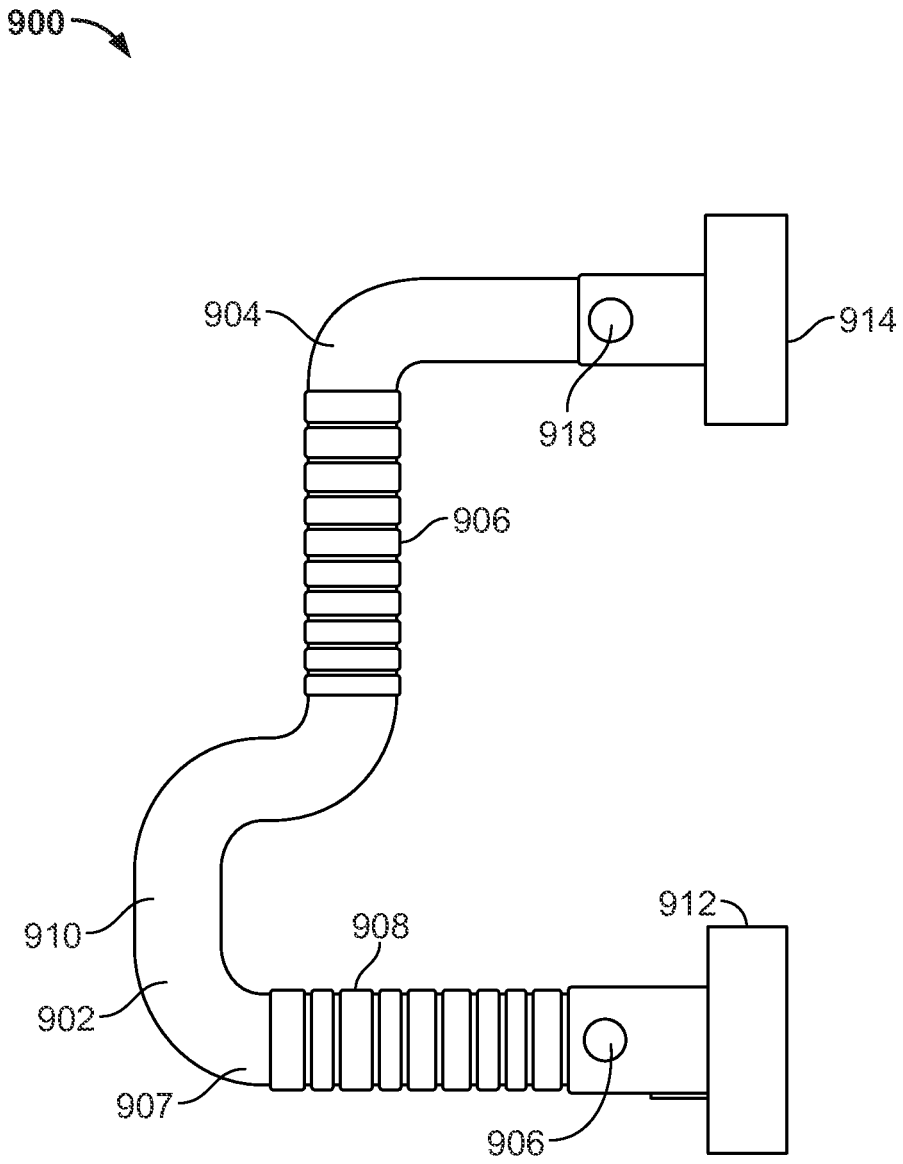
FIG. 9 is a perspective view of a third exemplary embodiment of the exercise device according to the disclosure.

FIG. 9 shows a third embodiment of exercise device 900. First base 912 and second base 914 attach to a first tube 902 and second tube 904 with connection point, or rivet 916, 918. First tube 902 and second tube 904 may embody various shapes and angles. First tube 902 may have a vertical handle 907 with handle grip 908 and second tube 904 may have a horizontal handle 905 with handle grip 906. Three right angles form an extension portion 910, the extension portion 910 allowing handle 907 to be sufficiently long to accommodate handle grip 908, or a user's hand.

Figure 10:
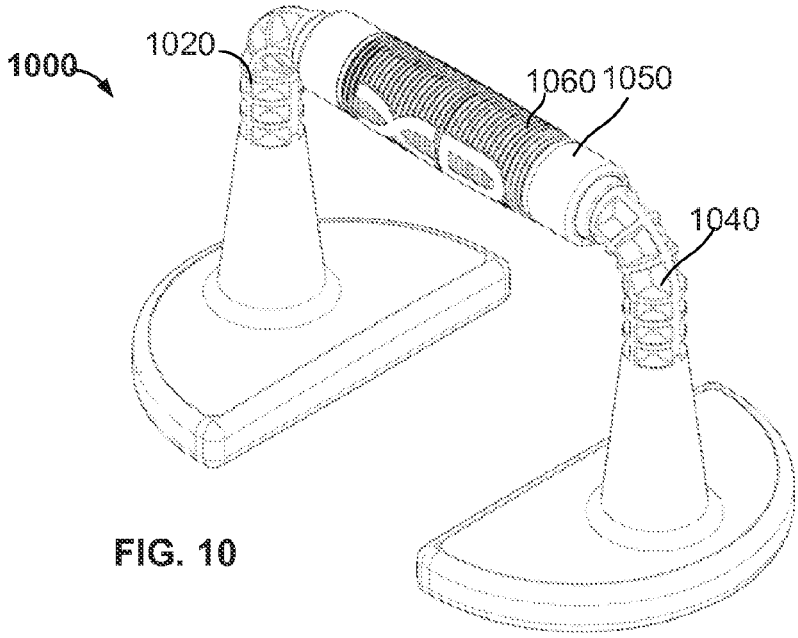
FIG. 10 shows a fourth exemplary embodiment of the exercise device in a perspective view.
Figure 11:
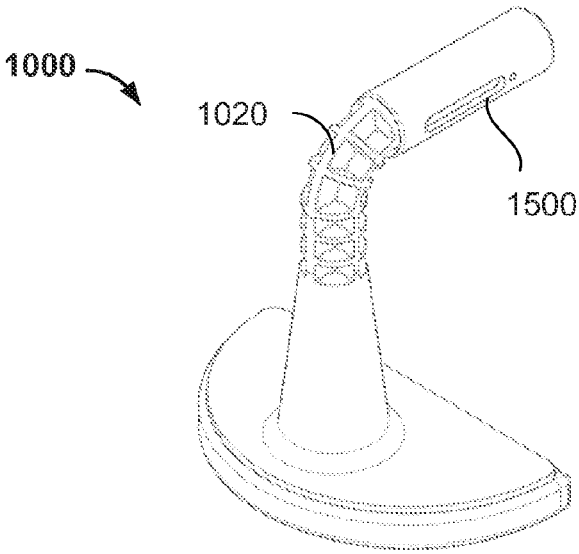
FIG. 11 shows a section of the fourth embodiment of the exercise device.
Figure 12:
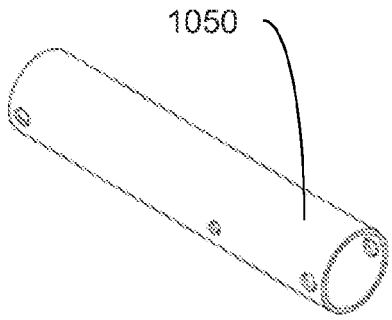
FIG. 12 shows a section of the fourth embodiment of the exercise device.

FIGS. 10-12 shows a fourth exemplary embodiment of the exercise device. In this embodiment, the device 1000 may be made from plastic. FIG. 10 shows the device 1000 in a perspective view, with handle grip 1060 covering handle 1050. The base, foot tube, and L-shaped tube may be rigidly formed from one continuous piece 1020, as shown in FIG. 11. The tubular ends of each continuous piece 1020, 1040 of device 1000 may be inserted into handle 1050, as shown in FIG. 12, and covered with grip 1060. Pins (not shown) and slots 1500 may operate in the same way as the embodiment shown in FIG. 6 and FIG. 7.

What is claimed is:

1. An exercise device comprising:

a generally L-shaped first tube including a handle end and a support end having a generally perpendicularly oriented base affixed thereto;

a generally L-shaped second tube including a handle end and a support end having a generally perpendicularly oriented base affixed thereto;

a generally tubular handle configured to engage the handle end of the first tube and the handle end of the second tube;

a spring arranged to bias at least one of the handle end of the first tube and the handle end of the second tube inwardly with respect to the handle wherein a pulling force of the handle in a perpendicular direction from the bases causes the bases to compress together.

2. The exercise device of claim 1 wherein at least one of the first tube and the second tube is slidably engaged with the handle.

3. The exercise device of claim 1 wherein one of the first tube and the second tube is slidably engaged with the handle and the other one of the first tube and the second tube is rigidly engaged with the handle.

4. The exercise device of claim 1 further comprising at least one foot at least partially covering at least one of the bases.

5. The exercise device of claim 1 further comprising at least one foot pad disposed on at least one of the bases.

6. The exercise device of claim 1 further comprising a hand grip adapted to at least partially cover the handle.

* * * * *